US006828284B2

(12) United States Patent
Howell et al.

(10) Patent No.: US 6,828,284 B2
(45) Date of Patent: Dec. 7, 2004

(54) FLOURINATED COMPOSITIONS COMPRISING PHOSPHORUS

(75) Inventors: Jon Lee Howell, Bear, DE (US); Erik William Perez, Pennsauken, NJ (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 489 days.

(21) Appl. No.: 09/923,838

(22) Filed: Aug. 6, 2001

(65) Prior Publication Data

US 2003/0073588 A1 Apr. 17, 2003

(51) Int. Cl.[7] ..... C10M 131/00; C10M 169/02; G11B 5/71

(52) U.S. Cl. ..... 508/182; 508/423; 508/429; 508/431; 508/433; 508/441; 558/177; 558/183; 558/203; 558/204; 428/422

(58) Field of Search ..... 508/423, 429, 508/182

(56) References Cited

U.S. PATENT DOCUMENTS

| | | | | |
|---|---|---|---|---|
| 3,083,224 A | | 3/1963 | Brace et al. | |
| 3,306,855 A | | 2/1967 | Borecki | |
| 3,308,207 A | | 3/1967 | Christian et al. | |
| 3,308,208 A | | 3/1967 | Christian et al. | |
| 3,337,655 A | | 8/1967 | Christian et al. | |
| 3,367,868 A | | 2/1968 | Skehan et al. | |
| 3,412,181 A | | 11/1968 | Braun | |
| 3,567,802 A | | 3/1971 | Garth | |
| 3,899,366 A | | 8/1975 | Talkowski | |
| 4,443,349 A | * | 4/1984 | Snyder et al. | 508/564 |
| 4,536,444 A | | 8/1985 | Sumiya et al. | |
| 4,877,815 A | | 10/1989 | Buckmaster et al. | |
| 5,069,973 A | | 12/1991 | Saito et al. | |
| 5,091,249 A | | 2/1992 | Nishikawa et al. | |
| 5,112,622 A | | 5/1992 | Ng | |
| 5,128,216 A | | 7/1992 | Ng | |
| 5,132,446 A | | 7/1992 | Tohzuka et al. | |
| 5,376,289 A | | 12/1994 | Montagna et al. | |
| 5,442,084 A | | 8/1995 | Lal | |
| 5,550,277 A | | 8/1996 | Paciorek et al. | |
| 5,556,707 A | | 9/1996 | Usuli et al. | |
| 5,607,782 A | | 3/1997 | Ishida et al. | |
| 5,707,742 A | | 1/1998 | Usuki et al. | |
| 5,874,169 A | | 2/1999 | Falcone | |
| 5,985,403 A | * | 11/1999 | Nakakawaji et al. | 428/65.3 |
| 6,083,600 A | | 7/2000 | Kasai et al. | |
| 6,140,410 A | * | 10/2000 | Kolouch | 524/520 |
| 6,177,196 B1 | * | 1/2001 | Brothers et al. | 428/422 |
| 6,184,187 B1 | | 2/2001 | Howell et al. | |
| 6,235,689 B1 | * | 5/2001 | Falcone | 508/423 |
| 6,559,108 B1 | * | 5/2003 | Howell et al. | 508/427 |

FOREIGN PATENT DOCUMENTS

| | | |
|---|---|---|
| EP | 0338531 A2 | 10/1989 |
| EP | 0605403 A2 | 7/1994 |
| EP | 0606640 A | 7/1994 |
| JP | 59154647 A | 9/1984 |
| JP | 07097586 A | 9/1993 |
| JP | 07192253 A | 12/1993 |
| JP | 08045066 A | 7/1994 |
| JP | 07062377 A | 3/1995 |
| JP | 07065353 A | 3/1995 |
| JP | 07244839 A | 9/1995 |
| SU | 255269 A1 | 3/1970 |
| SU | 1810382 A1 | 4/1993 |
| WO | WO 0127916 A1 | 4/2001 |

OTHER PUBLICATIONS

Pavlenko et al: Esters of bis(perfluoroalkyl)phossphinic acids; J. Gen. Chem. USSR; vol. 59. No. 3; Aug. 20, 1989.

Yagupol'skii et al: Arylbis(heptafluoropropyl)phosphate oxides—electronic nature of the $P(O)(C_3F_7)$ grgroup; J. Gen. Chem. USSR; vol. 59. No. 3; Aug. 20, 1989.

* cited by examiner

*Primary Examiner*—Ellen M. McAvoy
(74) *Attorney, Agent, or Firm*—Kathryn M. Sanchez

(57) ABSTRACT

A composition that is or comprises a phosphorus-, perfluoropolyether-, and perfluoroalkyl-containing compound is provided. The compound comprises either (i) mono- or polyalkylene oxide linking groups between the phosphorus and the fluorocarbon group, or (ii) no linking group between the phosphorus and fluorocarbon group, or (iii) individual mixtures of (i) and (ii); and the fluorocarbon group can be the perfluoropolyether or perfluoroalkyl group. The compound can also be a partially esterified phosphate, a partially esterified phosphonate, a salt of a partially esterified phosphate, a salt of a partially esterified phosphonate, or mixtures of two or more thereof.

45 Claims, No Drawings

FLOURINATED COMPOSITIONS COMPRISING PHOSPHORUS

FIELD OF INVENTION

This invention relates to a fluorinated compound comprising phosphorus, to a composition comprising the compound, and to a process for producing the compound.

BACKGROUND OF THE INVENTION

Hereinafter trademarks are shown in upper case.

The fluorinated compounds can be used, for example, as surfactants and lubricants for example, for the computer disk industry, or as additives for perfluoropolyether (hereinafter PFPE) compositions including oil and grease lubricants to inhibit corrosion and rust of metals.

PFPEs have excellent thermal and oxidative stability and are used as greases, hydraulic fluids, and oils for service under extreme or demanding conditions under which conventional oils and greases are inadequate. Examples are uses at temperatures above 260° C. and up to 370° C. to 425° C., depending on the particular oil or grease. These oils and greases are available from a number of commercial sources, including E. I. du Pont de Nemours & Company, which markets them under the KRYTOX trademark. The term "grease" as used herein comprises one or more oils mixed with a particulate thickening agent, for instance particulate polytetrafluoroethylene.

While a PFPE grease per se is highly stable, it is permeable to oxygen and moisture. Thus, the grease does not form an effective barrier against rust and corrosion of metallic parts it contacts. Though generally the term "corrosion" refers to the oxidation of metal in contact with oxygen and "rust" refers to the oxidation of metal in contact with water, the term "corrosion" used herein, unless otherwise indicated, is interchangeable with or includes "rust".

Sodium nitrite can be added as corrosion inhibitor to a PFPE grease, but it is not soluble in the grease. It is present as a particulate dispersion. Ideally, a rust and corrosion inhibitor is present in solution to provide better protection and to eliminate any potential problem of separation from the grease.

Many organic phosphorus compounds have been suggested as corrosion inhibitors for PFPE greases. For example, U.S. Pat. No. 3,306,855 discloses a perfluoroalkyl ether phosphate containing at least one acidic hydrogen and U.S. Pat. No. 5,550,277 discloses a variety of fully and partially esterified phosphates and phosphates, some of which are acidic. Some of these inhibitors contain large quantities of costly perfluoroalkyl substituents. Others, such as those partially esterified phosphates disclosed in U.S. Pat. No. 5,550,277, require formation of an intermediate fluoroether-substituted phenol that is very difficult to synthesize in a commercial process.

Furthermore, the use of acidic corrosion inhibitors is contraindicated in admixture with a PFPE grease containing the common sodium nitrite inhibitor because the acidic group can react with sodium nitrite to generate noxious nitrogen oxides. Since the presence of greases containing sodium nitrite has been pervasive and they are expensive to replace, there is a high probability that new greases will be placed in existing equipment lubrication reservoirs containing sodium nitrite.

Recently, U.S. Pat. No. 6,184,187 discloses many aryl-, perfluoroether-, and phosphorus-containing compounds having corrosion-inhibiting properties in admixture with PFPEs. A need remains, however, for corrosion inhibitors with higher thermal stability to match more closely the thermal stability of the PFPEs themselves.

SUMMARY OF THE INVENTION

According to a first embodiment of the invention, a composition that is or comprises a phosphorus-, perfluoropolyether-, and perfluoroalkyl-containing compound is provided wherein the compound comprises either (i) mono- or polyalkylene oxide linking groups between the phosphorus and the fluorocarbon group, or (ii) no linking group between the phosphorus and fluorocarbon group, or (iii) individual mixtures of (i) and (ii); and the fluorocarbon group can be the perfluoropolyether or perfluoroalkyl group.

According to a second embodiment of the invention, a composition that is or comprises a phosphorus-, perfluoropolyether-, and perfluoroalkyl-containing compound is provided, which is a partially esterified phosphate, a partially esterified phosphonate, a salt of a partially esterified phosphate, a salt of a partially esterified phosphonate, or mixtures of two or more thereof wherein the compound comprises either (i) mono- or poly-alkylene oxide linking groups between the phosphorus and the fluorocarbon group, or (ii) no linking group between the phosphorus and fluorocarbon group, or (iii) individual mixtures of (i) and (ii); and the fluorocarbon group can be the perfluoropolyether or perfluoroalkyl group.

DETAILED DESCRIPTION OF THE INVENTION

The following definitions, listed alphabetically, are employed herein.

a is 3 to 30;

b is zero or 1;

c and d are numbers such that the c/d ratio ranges from 0.01 to 0.5, and the formula weight ranges from 400 to 15,000;

e and f are numbers such that the e/f ratio ranges from 0.3 to 5, and the formula weight is from 400 to 15000;

E is oxygen or sulfur;

f see e and f above;

g, h and i are numbers such that (g+h) ranges from 1 to 50, the i/(g+h) ratio ranges from 0.1 to 0.05, and the formula weight is from 400 to 15,000;

j is a number such that the formula weight ranges from 400 to 15,000;

J is a fluoroalkyl group selected from the group consisting of $CF_3$, $C_2F_5$, $C_3F_7$, $CF_2Cl$, $C_2F_4Cl$, $C_3F_6Cl$, or mixtures of two or more thereof;

$J^1$ is a fluoroalkyl group selected from the group consisting of $CF_3$, $C_2F_5$, $CF_2Cl$, and $C_2F_4Cl$;

$J^2$ is $C_2F_5$ or $C_3F_7$;

$J^3$ is selected from the group consisting of $CF_3$, $C_2F_5$, and $C_3F_7$;

$J^4$ is $CF_3$, or $C_2F_5$;

k is a number such that the formula weight ranges from 400 to 15,000;

l is a number such that the formula weight ranges from 400 to 15,000;

m has a value from 1 to 20;

M is hydrogen, alkali metal, alkaline earth metal, or ammonium;

p, q and r are numbers such that (p+q) ranges from 1 to 50, and the r/(p+q) ratio ranges from 0.1 to 0.05, and the formula weight is from 400 to 15,000;

each Q is independently F, Cl, or H;

r see p, q, and r above;

R is the same or different substituent chosen from hydrogen, alkyl, nitro, cyano, alkoxy, primary or secondary amino, sulfonyl, carboxyl, or phenoxy;

Rf is a polyether chain having a formula weight ranging from 400 to 15,000 and composed of repeating units selected from the group consisting of: (a) J-O—$(CF(CF_3)CF_2O)_c(CFXO)_dCFZ$, (b) $J^1$-O—$(CF_2CF_2O)_e(CF_2O)_fCFZ^1$, (c) $J^2$-O—$(CF(CF_3)CF_2O)_jCF(CF_3)$, (d) $J^3$-O—$(CQ_2—CF_2CF_2—O)_k$-$CQ_2$-$CF_2$—, (e) $J^4$-O—$(CF_2CF_2O)_1CF_2$—, (f) $J^3$-O—$(CF(CF_3)CF_2O)_g(CF_2CF_2O)_h(CFX—O)_i$—CFZ-, and (g) mixtures of two or more thereof and the units with formulae $CF_2CF_2O$ and $CF_2O$ are randomly distributed along the chain;

$Rf^1$ is Q-$(C_mF_{2m})$— representing a monovalent branched or straight chain polyfluoroalkyl group;

$Rf^2$ is a divalent perfluoropolyether chain segment that can have a number average formula weight of 500 to 15,000 and can be selected from the group consisting of (i) $(CF_2CF_2O)_e(CF_2O)_fCF_2$—, (ii) $(C_3F_6O)_p(CF_2CF_2O)_q(CFXO)_rCF_2$—, (iii) $(CF_2CF_2O)_k(C_3F_6O)_1CF(CF_3)$—, (iv) $CF(CF_3)O(C_3F_6O)_w$—$Rf^3$—O—$(C_3F_6O)_wCF(CF_3)$—, (v) $((CQ_2)CF_2CF_2O)_sCF_2CF_2$—, and mixtures of two or more thereof and the units with formulae $CF_2CF_2O$ and $CF_2O$ are randomly distributed along the chain;

$Rf^3$ is linear or branched $C_aF_{2a}$;

s is a number such that the formula weight ranges from 400 to 15,000;

w is independently 2 to 20;

x is 0.05 to 1;

X is —F, —$CF_3$, or mixtures thereof;

y is 0.05 to 2;

Y is $(CH_2)_zO(CH_2CH_2O)_{z^1}$ or $C_6R_4O$;

z is 1 to 4;

$z^1$ is 0, 1 or 2;

Z is —F, —Cl or —$CF_3$;

$Z^1$ is —F or —Cl,

The compounds disclosed in the first embodiment of the invention are also referred to as Class A compounds. Representative compounds within Class A include those shown in Classes A(i), A(ii), and A(iii) having the formulae shown below.

Class A(i) compounds have a mono- or polyalkylene oxide linking group between phosphorus and fluorocarbon groups.

$$[Rf\text{-}Y—]_{(3-y)}P(E)_b[—Y—Rf^1]_y \quad \text{(Formula IA)}$$

$$[Rf\text{-}Y—]_{(3-y)}P(E)_b[—OCH(Rf^1)_2]_y \quad \text{(Formula IB)}$$

$$[Rf^1—Y—]_2P(E)_b[—Y—Rf^2\text{-}Y—]P(E)_b[—Y—Rf^1]_2 \quad \text{(Formula IIA)}$$

$$[(Rf^1)_2CHO—]_2P(E)_b[—Y—Rf^2\text{-}Y—]P(E)_b[—OCH(Rf^1)_2]_2 \quad \text{(Formula IIB)}$$

Specific examples of compounds within Class A(i) include, but are not limited to, for Formula IA, $[F(CF(CF_3)CF_2O)_jCF(CF_3)CH_2O]P[OCH_2(CF_2)_3Cl]_2$ and $[F(CF(CF_3)CF_2O)_jCF(CF_3)CH_2O]_2P(O)[OCH_2CF_2CF_2CF_2Cl]$.

for Formula IB; $[F(CF(CF_3)CF_2O)_jCF(CF_3)CH_2O]P[OCH((CF_2)_5CF_3)_2]_2$ for Formula IIA, $[HCF_2CF_2CF_2CH_2O)]_2P[OCH_2CF_2O(CF_2CF_2O)_e(CF_2O)_fCF_2CH_2O]P[OCH_2CF_2CF_2CF_2H]_2$ and $[HCF_2CF_2CF_2CH_2O]_2P(O)[OCH_2CF_2O(CF_2CF_2O)_e(CF_2O)_fCF_2CH_2O]P(O)[OCH_2CF_2CF_2CF_2H]_2$.

for Formula IIB, $[(HCF_2CF_2CF_2)_2CHO]_2P[OCH_2CF_2O(CF_2CF_2O)_e(CF_2O)_fCF_2CH_2O]P[OCH(CF_2CF_2CF_2H)_2]_2$ Class A(ii) compounds do not have a mono- or polyalkylene oxide linking group include:

$$[Rf]_{(3-y)}\text{-}P(E)_b[Rf^1]_y \quad \text{(Formula III)}$$

$$[Rf^1]_2\text{-}P(E)_bRf^2\text{-}P(E)_b[Rf^1]_2 \quad \text{(Formula IV)}$$

Examples of compounds within Class A(ii) include, but are not limited to, for Formula III, $[CF_3CF_2O(CF_2CF_2O)_e(CF_2O)_fCF_2]P[CF_2CF_2CF_2CF_3]_2$ and $[F(CF(CF_3)CF_2O)_jCF(CF_3)]P(O)[CF_2CF_2CF_2CF_3]_2$.

for Formula IV, $[CF_3(CF_2)_4]_2P[(CF_2CF_2O)_e(CF_2O)_fCF_2]P[(CF_2)_4CF_3]_2$ and $[CF_3(CF_2)_8]_2P(O)—[(CF_2CF_2O)_e—(CF_2O)_f—CF_2]—P(O)[(CF_2)_8CF_3]_2$ Class A(iii) compounds are those having only one mono- or poly-alkylene oxide linking group. That is, when the perfluoroether has one mono- or poly-alkylene oxide linking group, the fluoroalkyl has none, or when the fluoroalkyl has a mono- or poly-alkylene oxide linking group, the perfluoroether has none.

$$[Rf\text{-}Y—]_{(3-y)}P(E)_b[Rf^1]_y \quad \text{(Formula V)}$$

$$[Rf\text{-}]_{(3-y)}P(E)_b[—Y—Rf^1]_y \quad \text{(Formula VIA)}$$

$$[Rf\text{-}]_{(3-y)}P(E)_b[—OCH(Rf^1)_2]_y \quad \text{(Formula VIB)}$$

$$[Rf^1\text{-}]_2P(E)_b[—Y—Rf^2\text{-}Y—]P(E)_b[Rf^1]_2 \quad \text{(Formula VII)}$$

$$[Rf^1\text{-}Y^1\text{-}]_2P(E)_b[Rf^2]P(E)_b[—Y—Rf^1]_2. \quad \text{(Formula VIIIA)}$$

$$[(Rf^1)_2—CHO]_2P(E)_b[Rf^2]P(E)_b[—OCH(Rf^1)_2]_2. \quad \text{(Formula VIIIB)}$$

Representative compounds within Class A(iii) include the following.

for Formula V, $[F(CF(CF_3)CF_2O)_jCF(CF_3)CH_2O]P[CF_2CF_2CF_2CF_3]_2$ and $[F(CF(CF_3)CF_2O)_jCF(CF_3)C_6H_4O]_2P(O)[CF_2CF_2CF_2CF_3]$.

for Formula VIA, $[CF_3CF_2O(CF_2CF_2O)_e(CF_2O)_fCF_2]P[OCH_2CH_2(CF_2)_3CF_3]_2$ and $[F(CF(CF_3)CF_2O)_jCF(CF_3)]_2P(O)[OCH_2CF_2CF_2CF_2CF_3]$.

for Formula VIB, $[CF_3CF_2O(CF_2CF_2O)_e(CF_2O)_fCF_2—]P[—OCH((CF_2)_3CF_3)_2]_2$ and $[F(CF(CF_3)CF_2O)_jCF(CF_3)]_2P(O)[—OCH((CF_2)_3CF_3)_2]$.

for Formula VII, $[H(CF_2)_3]_2P(O)[—OCH_2(CF_2CF_2O)_e(CF_2O)_f—CF_2CH_2—]OP(O)[(CF_2)_3H]_2$ for Formula VIIIA, $[H(CF_2)_3(CH_2)_2O]_2P[(CF_2CF_2O)_e—(CF_2O)_f—CF_2]P[—O(CH_2)_2(CF_2)_3H]_2$ for Formula VIIIB, $[(H(CF_2)_3)_2CHO]_2P[(CF_2CF_2O)_e(CF_2O)_fCF_2]P[OCH((CF_2)_3H)_2]_2$ The compounds of the second embodiment of the invention are also referred to as Class B compounds. Representative compounds within Class B are shown in Classes B(i), B(ii), and B(iii) having the formulae shown below.

Class B(i) compounds are those having mono- or polyalkylene oxide linking group between phosphorus and fluorocarbon group. Illustrative examples are shown as follows.

$$[Rf\text{-}Y—]_{(3-x-y)}—P(E)\text{-}[—Y—Rf^1]_y[OM]_x \quad \text{(Formula IXA)}$$

$$[Rf\text{-}Y—]_{(3-x-y)}—P(E)\text{-}[—OCH—(Rf^1)_2]_y[OM]_x \quad \text{(Formula IXB)}$$

$$[MO]_x[Rf^1\text{-}Y—]_{(2-x)}—P(E)[—Y—Rf^2\text{-}Y—]P(E)[—Y—Rf^1]_{(2-x)}[OM]_x \quad \text{(Formula XA)}$$

$$[MO]_x[(Rf^1)_2—CHO—]_{(2-x)}—P(E)[—Y—Rf^2\text{-}Y—]P(E)[—OCH—(Rf^1)_2]_{(2-x)}[OM]_x. \quad \text{(Formula XB)}$$

Specific examples of Class B(i) compounds include, but are not limited to, for Formula IXA; $[F(CF(CF_3)CF_2O)_jCF(CF_2)CH_2O]P(O)[OCH_2CF_3][OH]$ and $[F(CF(CF_3)CF_2O)_jCF(CF_3)C_6H_4O]P(O)[OCH_2CF_2CF_2CF_3][OH]$.

for Formula IXB; $[CF_3CF_2O(CF_2CF_2O)_e(CF_2O)_fCF_2CH_2O]P(O)[OCH_2CF_3][OH]$.

for Formula XA; $[HO][CF_3CH_2O]P(O)[OCH_2CF(CF_3)O(C_3F_6O)_w(CF_2)_4O(C_3F_6O)_wCF(CF_3)CH_2O]P(O)[OCH_2CF_3][OH]$ and $[HO][CF_3(CF_2)_3(CH_2)_2O]P(O)[OCH_2((CF_2)_2O)_e(CF_2O)_fCF_2CH_2O]P(O)[OCH_2CH_2(CF_2)_3CF_3][OH]$ For Formula XB; $[HO][(CF_3(CF_2)_2CHO]P(O)[OCH_2((CF_2)_2O)_e(CF_2O)_fCF_2CH_2O]P(O)[OCH_2CH_2(CF_2)_3CF_3][OH]$.

Class B(ii) compounds are those having no mono- or poly-alkylene oxide linking group between phosphorus and fluorocarbon groups. Illustrative examples are shown below.

$$[Rf\text{-}]_{(3-x-y)}\text{—}P(E)[\text{—}Rf^1]_y[OM]_x \text{ and} \quad \text{(Formula XI)}$$

$$[MO]_x[Rf^1\text{-}]_{(2-x)}\text{—}P(E)\text{—}Rf^2\text{-}P(E)[\text{—}Rf^1]_{(2-x)}[OM]_x \quad \text{(Formula XII)}$$

Examples of representative compounds within Class B(ii) include, but are not limited to, for Formula XI; $[CF_3CF_2O(CF_2CF_2O)_e(CF_2O)_fCF_2]P(O)[CF_2CF_2H][OH]$ and $[F(CF(CF_3)CF_2O)_g(CF_2CF_2O)_hCF_2OCF_2]P(O)[(CF_2)_4CF_3][OH]$.

for Formula XII; $[HO][CF_3CF_2CF_2]P(O)[(CF_2CF_2O)_e(CF_2O)_fCF_2]P(O)[CF_2CF_2CF_3][OH]$ and $[HO][CF_3CF_2]P(O)[(CF_2CF_2O)_e(CF_2O)_fCF_2]P(O)[CF_2CF_3][OH]$.

Examples of Class B(iii) compounds include, but are not limited to, those having only one mono-or poly-alkylene oxide linking group shown below.

$$[Rf\text{-}Y\text{—}]_{(3-x-y)}P(E)[\text{—}Rf^1]_y[OM]_x \quad \text{(Formula XIII)}$$

$$[Rf\text{-}]_{(3-x-y)}P(E)[\text{—}Y\text{—}Rf^1]_y[OM]_x \quad \text{(Formula XIVA)}$$

$$[Rf\text{-}]_{(3-x-y)}P(E)[\text{—}OCH\text{—}(Rf^1)_2]_y[OM]_x \quad \text{(Formula XIVB)}$$

$$[MO]_x[Rf^1\text{-}]_{(2-x)}P(E)[\text{—}Y\text{—}Rf^2\text{-}Y\text{—}]P(E)[\text{—}Rf^1]_{(2-x)}[OM]_x \quad \text{(Formula XV)}$$

$$[MO]_x[Rf^1\text{-}Y\text{—}]^{(2-x)}P(E)[\text{—}Rf^2\text{-}]P(E)[\text{—}Y\text{—}Rf^1]_{(2-x)}[OM]_x \quad \text{(Formula XVIA)}$$

$$[MO]_x[Rf^1\text{—}CHO\text{—}]_{(2-x)}P(E)[\text{—}Rf^2\text{-}]P(E)[\text{—}OCH\text{—}(Rf^1)_2]_{(2-x)[OM]x} \quad \text{(Formula XVIB)}$$

Specific examples of compounds within Class B(iii) include, but are not limited to, for Formula XIII, $[F(CF(CF_3)CF_2O)_jCF(CF_3)CH_2O]P(O)[(CF_2)_8H][OH]$ for Formula XIVA, $[CF_3O(CF_2CF_2CF_2O)_kCF_2CF_2]P(O)[OCH_2CF_2CF_2H][OH]$ for Formula XIVB, $[CF_3O(CF_2CF_2CF_2O)_kCF_2CF_2]P(O)[OCH_2((CF_2)_5H)_2][OH]$ for Formula XV, $[HO][CF_3(CF_2)_8]P(O)[OCH_2CF_2O(CF_2CF_2O)_e(CF_2O)_fCF_2CH_2O]P(O)[(CF_2)_8CF_3][OH]$ for Formula XVIA, $[HO][CF_3(CF_2)_2(CH_2)_2O]P(O)[(CF_2CF_2O)_e(CF_2O)_fCF_2]P(O)[O(CH_2)_2(CF_2)_2CF_3][OH]$ For Formula XVIB, $[HO][(HCF_2CF_2)_2CHO]P(O)[(CF_2CF_2O)_e(CF_2O)_fCF_2]P(O)[OCH(CF_2CF_2H)_2][OH]$

Synthesis

Compounds of Class A(i) and B(i)

Syntheses of the composition of the invention can be accomplished by the method described by Tohzuka in U.S. Pat. No. 5,132,446, which is incorporated herein by reference, by reaction of phosphorous oxychloride at elevated temperatures with a fluoroalcohol of the formula $R_f$-OH. Alternately, the composition can be produced by mixing the reactants in the presence of a dry aprotic organic base, such as triethylamine or pyridine, and allowing the reaction to proceed at, for example, room temperature until complete, either with or without solvent, as disclosed in U.S. Pat. Nos. 6,184,187 and 5,550,277, which are also incorporated herein by reference. Control over the specific reaction products is by stoichiometry. This reaction is followed by hydrolysis to form the corresponding acid ester. Additionally, the products are neutralized with a solution or suspension of the hydroxide or carbonate of the alkali metal, alkaline earth metal, or ammonium hydroxide solution, prior to isolation to provide the corresponding salt, producing a rust and corrosion prevention additive compatible with perfluoropolyether oils and greases containing sodium nitrite. The solution is washed with water to remove excess acid and salts, or base and salts, then vacuum-stripped to remove solvents and volatile components.

Compounds of Class A (ii) and B (ii)

These compounds can be produced by contacting a perfluoroalkyl or perfluoroether iodide with elemental phosphorus at elevated temperatures to produce and isolate an iodo phosphine. The isolated iodo phosphine can be contacted or reacted with a metalated perfluoroalkoxy methylene-containing compound, preparing the corresponding phosphorus (III) compounds. Oxidation with chlorine/water or hydrogen peroxide gives the phosphorus (V) oxide. Oxidation of the phosphorus (III) with chlorine followed by treatment with $H_2S$ or $Na_2S$ gives the thiophosphorus (V) materials.

Compounds of Class A(iii) and B(iii)

These compounds can produced by contacting a phosphorous oxychloride with the fluorinated polyether alcohol in a dry aprotic solvent to form a PFPE dichlorophosphorous oxide. The PFPE dichlorophosphorous oxide can then be reacted with the Grignard of a fluoroalkyl iodide in an appropriate solvent such as tetrahydrofuran (THF), followed by washing with water giving the desired products.

Use as Lubricant Improving Rust and Corrosion Inhibition

The phosphorus compounds of the present invention can be used as lubricants or as anticorrosion and antirust additives for all perfluoropolyether lubricants. For instance, in such uses as lubricants for disc information storage devices such as computer diskette. These compounds are variously soluble or dispersible in a perfluoropolyether oil or grease and provide antirust and anticorrosion protection to the oil or grease, thereby improving wear of parts lubricated or in contact with the oil or grease. An alkali metal, alkaline earth metal, or ammonium salt of the partially esterified phosphorus compound either allow sodium nitrite to be replaced or, since they are compatible with the sodium nitrite, provide the option to retain sodium nitrite in the formulation. Alternatively, the phosphorus compound can be used in admixture with nitrite-containing formulations in lubricant reservoirs. The present invention further provides perfluoropolyether oils, greases, and fluids containing an effective amount of the inhibitor.

The term "effective amount" means the amount required to produce a useful level of inhibition for the required service life of the device containing the oil or grease at the operating temperature. Various metals differ considerably in the amount of corrosion and rust that will occur and the amount of inhibitor required to prevent it. Longer service life, higher service temperatures, and higher molecular weight phosphorus compound can require larger amounts of the phosphorus compound. It can correspond to a concentration of from 0.1 to 100%, preferably 1 to 10%, and most preferably 3 to 7%. The compound can be added at the point of use, but is preferably added during manufacture or packaging of the perfluoropolyether, when appropriate quality control is more likely to be available.

Representative perfluoropolyethers having neutral end groups, utilizable for the formulation of oils and greases are available on the market under the trade-names FOMBLIN (from Ausimont, Milan, Italy), KRYTOX (from E. I. du Pont de Nemours and Company, Wilmington, Del., USA), and DEMNUM (from Daikin, Osaka, Japan).

According to the invention, a grease composition is provided which can comprise an effective amount of one or more of the compounds disclosed above; particulate thickeners, for instance polytetrafluoroethylene, boron nitride, silica, clay, polyurethane, metallic soaps, diatomaceous earths, basic metallic salts, and the like, which act as thickening agents; and a liquid perfluoropolyether. For example, the total perfluoropolyether oil fraction can be present in the grease in the range of from about 40% to about 95%, preferably 60% to 85% by weight, based on the weight of the grease. Other compounds such as perfluoroalkyl surfactants, polyoxyperfluoroalkyl surfactants, or other additives known to one skilled in the in the art, such as stabilizers, anticorrosive agents, anti-wear agents, etc can also be present ion the grease composition.

Magnetic disk drives, magnetic hard disks, or magnetic optical disks, are devices that can be used as a rotatable thin film magnetic media with data tracks, a read/write transducer for reading/writing the information on the tracks, a slider for holding the transducer to the tracks, and a flying mode above the media. During operation, the transducer head slides against the surface of the disk as the disk begins to rotate. The transducer head, when the disk reaches a predetermined rotational speed, floats in air at a predetermined distance from the surface of the disk. When the operation of the disk drive terminates, the transducer head begins to slide against the surface. Such sliding repeats every time the head and disk assembly is driven.

To maintain the slider as close as possible to the media, or the transducer head as close to its recording surface as possible to minimize the flying height of the head, requires a smooth recording surface. Excessive stiction (static coefficient of friction) and friction can result if the head surface and the recording surface are too flat. Excessive stiction and friction can cause wear to the head and recording surfaces.

The invention also provides a recording medium, which comprises a fluorinated compound. The fluorinated compound is the same as that disclosed above in the first and second embodiment of the invention. The compound or a grease comprising the compound can be used as a lubricant, coating, or an additive to the lubricant, to lubricate or coat the thin film disks and sliders to ensure the regular transducer fly height.

Generally, a recording medium includes a magnetic medium (hard or flexible), magneto-optical medium, optical medium, or combinations thereof and can include either audio or videotape. A magnetic recording medium can comprise a magnetic layer on a non-magnetic substrate. The magnetic layer can comprise a protective overcoat on the magnetic layer. A lubricant can be present as a lubricant topcoat on the magnetic layer or on the protective overcoat, if present. The lubricant or lubricant topcoat comprises, consists essentially of, or consists of the compound disclosed herein. The non-magnetic substrate, the magnetic layer, and the protective overcoat are well known to one skilled in the art. See, for example, U.S. Pat. No. 5,874,169, disclosure of which is incorporated herein by reference. Therefore the description of the non-magnetic substrate, the magnetic layer, and the protective overcoat is omitted herein for the interest of brevity. The invention disclosed herein is suitable for all recording media.

The fluorinated compound can be diluted in a solvent before it is applied to the disk. Any solvent having a vapour pressure that can readily evaporate at ambient temperature and pressure can be used. Examples of such solvents can include a commercially available fluorocarbon, hydrofluorocarbon, perfluorocarbon, or combinations of two or more thereof The concentration of the phosphorus-containing fluorocarbon compound in the solvent, if used, can be from about 0.0001 to about 99% by weight.

The fluorinated compound can be applied to the magnetic recording medium by any means known to one skilled in the art such as, for example, dip coating, spraying, spin coating, or vapor deposition. The pulling-up speed, the density of the phosphorus-containing fluorocarbon compound, and the surface tension are relevant for determining the film thickness of the phosphorus-containing fluorocarbon compound. See 'Dip-Coating of Ultra-Thin Liquid Lubricant and its Control for Thin-Film Magnetic Hard Disks' in IEEE Transactions on Magnetics, vol. 31, no. 6, November 1995, for further details.

The lubricant can be applied to a thickness of less than about 300 nm, and most preferably a thickness of about 100 nm to about 300 nm.

The invention is further illustrated, but not limited, by the following examples.

EXAMPLES 1–6

A first Reactant 1, a perfluoropolyalkylether alcohol (KRYTOX Alcohol, also from E. I. Du Pont de Nemours & Co.) was added to a nitrogen purged 500-ml three-neck round-bottom flask. Equal volume of a perfluorinated solvent (such as HFE-7100 Specialty Liquid, perfluorobutylmethylether, available from 3M, Minneapolis, Minn.) was added to the alcohol to produce a mixture. Phosphorous oxychloride was added to the mixture. With vigorous stirring from an overhead stirrer, base was slowly dripped into the mixture, not allowing the mixture temperature to reach above 30° C. After addition of a base shown in Table 1 (all bases obtained from Sigma-Aldrich Fine Chemicals, Milwaukee, Wis.) the mixture was heated to reflux for one hour at about 55–60° C. The mixture was then allowed to cool to about 23° C.

A second Reactant 2, a perfluoroalkyl alcohol (available from Oakwood Products, Inc., West Columbia, S.C.) was then added to the flask to form a solution. With vigorous stirring, base was slowly dripped into the solution not allowing the solution temperature to reach above 30° C. After addition of the base, the reaction mixture was heated to reflux for one hour at about 55–60° C. The reaction solution was allowed to cool to room temperature. Water (100 g, 5.56 mol) was slowly added to the reaction mixture solution and the mixture was heated to reflux for one hour. The solution was allowed to cool to room temperature. Dilute hydrochloric acid (100 g, 5% in water) was added to the solution and stirred for 15 minutes to form a mixture. The mixture was allowed to separate with the stirring off. The aqueous layer was removed and a salt solution (sodium chloride; 100 g, 1% in water) was added. The mixture was stirred for 15 minutes. The mixture was then allowed to separate and the aqueous layer was removed. This step was repeated twice more for a total of three salt water washes. After the final wash, the lower product layer was separated using a separatory funnel. The solvent was distilled off under atmospheric pressure at 60° C. After the solvent no longer distilled, oil pump vacuum was applied. The resulting product was then filtered CELITE and filter paper.

Table 1 shows the relevant amounts of reagents required to produce the desired compounds. In the table, aa denotes KRYTOX Alcohol (average molecular weight=1571 g/mol); bb is pyridine; cc is triethylamine; dd is trifluoroethanol; ee is pentafluoropropanol; ff is 1,1,1,3,3,3-hexafluoroproanol; gg is 2,2,3,3-tetrafluoro-1-propanol; hh is 1H,1H,2H,2H-perfluorooctanol; and ii is (perfluorocyclohexyl) methanol.

TABLE 1

Compositions of Examples 1–6.

| Example | Reactant 1[aa] | $OPCl_3$ | Base | Reactant 2 | Base |
|---|---|---|---|---|---|
| 1 | 141.4 | 9.20 | 7.3[bb] | 12.6[dd] | 10.6[bb] |
| 2 | 98.19 | 6.14 | 5.0[bb] | 15.0[ee] | 7.0[bb] |
| 3 | 73.25 | 4.60 | 3.6[bb] | 10.2[ff] | 4.8[bb] |
| 4 | 141.10 | 9.20 | 7.3[cc] | 16.6[gg] | 10.5[cc] |
| 5 | 70.40 | 4.60 | 4.6[cc] | 23.7[hh] | 6.8[cc] |
| 6 | 80.10 | 5.20 | 5.4[cc] | 22.3[ii] | 7.9[cc] |

EXAMPLE 7

A first Reactant 1, a diol (partially fluorinated diol from Oakwood Products, Inc.) was added to a nitrogen-purged 500-ml three-neck round-bottom flask. Equal volume of a perfluorinated solvent (HFE-7100 Specialty Liquid; 3M) was added to the alcohol. Phosphorous oxychloride was then added to the alcohol. With vigorous stirring from an overhead stirrer, base was slowly dripped into the flask to form a reaction mixture, not allowing the flask temperature to reach above 30° C. After addition of the base, the reaction mixture was heated to reflux for one hour at bout 55–60° C. The reaction mixture was then allowed to cool to about 23° C. to produce a solution. A second Reactant 2, a perfluoropolyalkylether alcohol (KRYTOX alcohol) was then added to the solution. With vigorous stirring, base was slowly dripped in to the solution not allowing the solution temperature to reach above 30° C. After addition of the base, the reaction mixture was heated to reflux for one hour (about 55–60° C.). The reaction mixture was allowed to cool to room temperature. Water (100 g, 5.56 mol) was slowly added to reaction mixture and the mixture was heated to reflux for one hour. The solution was allowed to cool to room temperature. Dilute hydrochloric acid (100 g, 5% in water) was added to the solution and stirred for 15 minutes. The mixture was allowed to separate with the stirring off. The aqueous layer was removed and a salt solution (sodium chloride; 100 g, 1% in water) was added. The mixture was stirred for 15 minutes. The mixture was then allowed to separate and the aqueous layer was removed. This step was repeated twice more for a total of three salt water washes. After the final wash, the lower product layer was separated using a separatory funnel. The solvent was distilled off under atmospheric pressure at 50° C. After the solvent no longer distilled, oil pump vacuum was applied. The resulting product was then filtered through CELITE and filter paper. Table 2 shows the reaction parameters. In the table, jj is 1H,1H, 10H,10H-perfluoro-1,10-decandiol, aa and bb are the same as disclosed in Table 1.

TABLE 2

Composition of Example 7

| Example | Reactant 1[jj] | $OPCl_3$ | Base | Reactant 2 | Base |
|---|---|---|---|---|---|
| 7 | 25.0 | 17.8 | 2.0[bb] | 348.0[aa] | 23.5[bb] |

Table 2 shows the relevant amounts of reagents required to produce the desired compound.

COMPARATIVE EXAMPLES A AND B

Reactant 1, a perfluoropolyalkylether alcohol (KRYTOX alcohol) was added to a nitrogen-purged 500-ml three-neck round-bottom flask. Equal volume of a perfluorinated solvent (HFE-7100 Specialty Liquid; 3M) was added to the alcohol. Phosphorus oxychloride (Sigma-Aldrich Aldrich Fine Chemicals) was added. With vigorous stirring from an overhead stirrer, base was slowly dripped into the reaction flask to form a reaction mixture, not allowing the pot contents' temperature to reach above 30° C. The reaction mixture was heated to reflux for one hour (about 55–60° C.). The reaction mixture was then allowed to cool to room temperature (about 23° C.). Water (500 g, 27.8 mol) was slowly added to the reaction mixture and the mixture was heated to reflux for one hour. The mixture was allowed to cool to room temperature. Dilute hydrochloric acid (1000 g, 5% in water) was added to the solution and stirred for 15 minutes. With stirring off, the mixture was allowed to separate. The aqueous layer was removed and a salt solution (sodium chloride; 1000 g, 1% in water) was added. The mixture was stirred for 15 minutes. The mixture was then allowed to separate and the aqueous layer was removed. This step was repeated twice more for a total of three salt water washes. After the final wash, the product layer was separated using a separatory funnel. The solvent was distilled off under atmospheric pressure at 50° C. After the solvent no longer distilled, oil pump vacuum was applied. The resulting product was then filtered. Table 3 shows the relevant amounts of reagents required to produce the desired compounds. In the table, aa, bb, and cc are the same as those disclosed in Table 1.

TABLE 3

Composition of Comparative Examples

| Example | Reactant 1[aa] | $OPCl_3$ | Base |
|---|---|---|---|
| A | 2300.0 | 248.0 | 171.8[bb] |
| B | 2333.0 | 102.0 | 120.0[cc] |

Test Method

Rust/Corrosion Testing Procedure

The procedure was American Society for Testing Materials, ASTM D-665, modified as described.

The test coupons were C1018 centerless ground cylindrical coupons (0.25 inch or 0.635 cm diameter, 2.5 inch or 6.35 cm length) with a 1/16-inch (0.16 cm) slot, part #2200 from Metal Samples Co., Munford, Ala.

Medium hard water (MIL-I-25017E) was prepared using three stock solutions, 16.4 g/l sodium bicarbonate, 13.2 g/l anhydrous calcium chloride, and 8.2 g/l anhydrous magnesium sulfate. Sodium bicarbonate stock solution (10 ml) was pipetted into 800 ml distilled water in a 1-liter volumetric flask, and shaken vigorously. While swirling the contents of the flask, calcium chloride stock solution (10 ml) and magnesium sulfate (10 ml) were pipetted into the flask followed by adding distilled water to bring the volume to one liter to form a solution. The solution was mixed thoroughly to produce a solution free and clear of precipitation.

Test coupons were cleaned in toluene or Stoddard solvent using sonicator for 15 minutes. They were then stored in a sealed container filled with fresh solvent and soaked in a fluorochemical solvent such as VERTREL XF (1,1,1,2,3,4,4,5,5,5-decafluoropentane, E. I. du Pont de Nemours and Company) for at least 5 minutes. The coupon was then air-dried for 10 minutes and avoided contamination. To test the anticorrosion additives of the present invention, in each Example and Comparative Example a 5% by weight solution of the phosphorus-containing additive in KRYTOX GPL 105 oil was used to give the 5% additive formulation. The coupons were coated thoroughly by dipping for one minute in the additive formulation to be tested. Excess formulation was allowed to drain for one hour. The coupons were placed into a beaker of medium hard water (see below) held at 80° C. The volume was adjusted to have half of each coupon immersed into the solution. The test was executed for 24 hours. The test coupons were removed from the solution, wiped with a paper towel to remove loose rust, and given a final evaluation.

The above procedure was modified in order to test these high performance rust inhibitors as follows: the formulations were heated for 24 hours at elevated temperatures then allowed to cool to about 23–25° C. before dipping cleaned pin into the formulation for one minute.

Evaluations: Excellent—no rust or light rust; Good—moderate rust occurring; Fair—severe rust occurring covering not more than 35% of the surface; and poor—severe rust covering more than 35% of the surface.

Results are shown in Table 4.

TABLE 4

Pin Test Results.

| Sample | 200° C. |
|---|---|
| Example 1 | Fair |
| Example 2 | Good |
| Example 3 | Poor |
| Example 4 | Good |
| Example 5 | Good |
| Example 6 | Fair/Good |
| Example 7 | Good |
| Comparative Example A | Poor |
| Comparative Example B | Poor |

Table 4 shows the improvement in performance of the compositions in Examples 1–7 over Comparative Examples A and B after the 5% formulation had been heated for 24 hours at 200° C. and then tested by the Test Method described above.

What is claimed is:

1. A phosphorus-, perfluoropolyether-, and perfloroalkyl-containing compound comprising either (i) mono- or poly-alkylene oxide linking groups between the phosphorus and the fluorocarbon group, or (ii) no linking group between the phosphorus and fluorocarbon group, or (iii) individual mixture of (i) and (ii); said compound does not contain an aryl or arylene group; and said fluorocarbon group is said perfluoropolyether or perfluoroalkyl group.

2. A compound according to claim 1 comprising a mono- or poly-alkylene oxide linking groups between the phosphorus and the fluorocarbon group.

3. A compound according to claim 2 wherein said compound has the formula of $[Rf\text{-}Y\text{—}]_{(3-y)}P(E)_b[\text{—}Y\text{—}Rf^1]_y$;

Rf is a polyether chain having a formula weight ranging from 400 to 15,000 and composed of repeating units selected from the group consisting of: (a) $J\text{-}O\text{—}(CF(CF_3)CF_2O)_c(CFXO)_dCFZ$, (b) $J^1\text{-}O\text{—}(CF_2CF_2O)_e(CF_2O)_fCFZ^1$, (c) $J^2\text{-}O\text{—}(CF(CF_3)CF_2O)_jCF(CF_3)$, (d) $J^3\text{-}O\text{—}(CQ_2\text{-}CF_2CF_2\text{—}O)_k\text{-}CQ_2\text{-}CF_2\text{—}$, (e) $J^4\text{-}O\text{—}(CF_2CF_2O)_1CF_2\text{—}$, (f) $J^3\text{-}O\text{—}(CF(CF_3)CF_2O)_g(CF_2CF_2O)_h(CFX\text{—}O)_i\text{—}CFZ\text{-}$, and (g) mixtures of two or more thereof and the units with formulae $CF_2CF_2O$ and $CF_2O$ are randomly distributed along the chain;

J is a fluoroalkyl group selected from the group consisting of $CF_3$, $C_2F_5$, $C_3F_7$, $CF_2Cl$, $C_2F_4Cl$, $C_3F_6Cl$, or mixtures of two or more thereof;

$J^1$ is a fluoroalkyl group selected from the group consisting of $CF_3$, $C_2F_5$, $CF_2Cl$, and $C_2F_4Cl$;

$J^2$ is $C_2F_5$ or $C_3F_7$;

$J^3$ is selected from the group consisting of $CF_3$, $C_2F_5$, and $C_3F_7$;

$J^4$ is $CF_3$ or $C_2F_5$;

c and d are numbers such that the c/d ratio ranges from 0.01 to 0.5, and the formula weight ranges from 400 to 15,000;

e and f are numbers such that the e/f ratio ranges from 0.3 to 5, and the formula weight is from 400 to 15000;

g, h and i are numbers such that (g+h) ranges from 1 to 50, the i/(g+h) ratio ranges from 0.1 to 0.05, and the formula weight is from 400 to 15,000;

j is a number such that the formula weight ranges from 400 to 15,000;

k is a number such that the formula weight ranges from 400 to 15,000;

l is a number such that the formula weight ranges from 400 to 15,000;

each Q is independently F, Cl, or H;

b is zero or 1;

E is oxygen or sulfur;

$Rf^1$ is $Q\text{-}(C_mF_{2m})\text{—}$ representing a monovalent branched or straight chain polyfluoroalkyl group;

m has a value from 1 to 20;

X is —F, —$CF_3$, or mixtures thereof;

y is 0.05 to 2;

Y is $(CH_2)_zO(CH_2CH_2O)_{z^1}$;

z is 1 to 4;

$z^1$ is 0, 1 or 2;

Z is —F, —Cl or —$CF_3$;

$Z^1$ is —F or —Cl.

4. A compound according to claim 2 wherein said compound has the formula of $[Rf\text{-}Y\text{—}]_{(3-y)}P(E)_b[\text{—}OCH(Rf^1)_2]_y$; and Rf, Y, y, E, b, and $Rf^1$ are as recited in claim 3.

5. A compound according to claim 2 wherein said compound has the formula of $[Rf^1\text{-}Y\text{—}]_2P(E)_b[\text{—}Y\text{—}Rf^2\text{-}Y\text{—}]P(E)_b[\text{—}Y\text{—}Rf^1]_2$;

$Rf^1$, Y, E, and b are as recited in claim 3;

$Rf^2$ is a divalent perfluoropolyether chain segment that can have a number average formula weight of 500 to 15,000 and can be selected from the group consisting of (i) $(CF_2CF_2O)_e(CF_2O)_fCF_2\text{—}$, (ii) $(C_3F_6O)_p(CF_2CF_2O)_q(CFXO)_rCF_2\text{—}$, (iii) $(CF_2CF_2O)_k(C_3F_6O)_1CF(CF_3)\text{—}$, (iv) $CF(CF_3)O(C_3F_6O)_w\text{—}Rf^3\text{-}O\text{—}(C_3F_6O)_wCF(CF_3)\text{—}$, (v) $((CQ_2)CF_2CF_2O)_sCF_2CF_2$, and mixtures of two or more thereof and the units with formulae $CF_2CF_2O$ and $CF_2O$ are randomly distributed along the chain;

$Rf^3$ is linear or branched $C_aF_{2a}$;

a is 3 to 30;

e, f, k, and l are the same as recited in claim 3;

p, q and r are numbers such that (p+q) ranges from 1 to 50, and the r/(p+q) ratio ranges from 0.1 to 0.05, and the formula weight is from 400 to 15,000;

s is a number such that the formula weight ranges from 400 to 15,000; and w is independently 2 to 20.

6. A compound according to claim 2 wherein said compound has the formula of $[(Rf^1)_2CHO—]_2P(E)_b[—Y—Rf^2-Y—]P(E)_b[—OCH(Rf^1)_2]_2$; and $Rf^1$, E, b, Y, and $Rf^2$ are as recited in claim 5.

7. A compound according to claim 1 comprising no linking group between the phosphorus and fluorocarbon group.

8. A compound according to claim 7 wherein said compound has the formula of $[Rf]_{(3-y)}—P(E)_b[Rf^1]_y$; and Rf, y, E, b, and $Rf^1$ are the same as recited in claim 3.

9. A compound according to claim 7 wherein said compound has the formula of $[Rf^1]_2-P(E)_bRf^2-P(E)_b[Rf^1]_2$; and $Rf^1$, E, b, and $Rf^2$, are as recited in claim 5.

10. A compound according to claim 1 comprising only one mono-alkylene oxide or polyalkylene oxide linking group and having the proviso of (1) when said perfluoroether has a mono- or poly-alkylene oxide linking group, said fluoroalkyl has no liking group and (2) when said fluoroalkyl has a mono- or poly-alkylene oxide linking group, said perfluoroether has no linking group.

11. A compound according to claim 10 wherein said compound has the formula of $[Rf-Y—]_{(3-y)}P(E)_b[Rf^1]_y$; and Rf, Y, y, E, b, and $Rf^1$ are the same as recited in claim 3.

12. A compound according to claim 10 wherein said compound has the formula of $[Rf-]_{(3-y)}P(E)_b[—Y—Rf^1]_y$; and Rf, y, E, b, Y and $Rf^1$ are the same as recited in claim 5.

13. A compound according to claim 10 wherein said compound has the formula of $[Rf-]_{(3-y)}P(E)_b[—OCH(Rf^1)_2]_y$; and Rf, Y, y, E, b, and $Rf^1$ are the same as recited in claim 3.

14. A compound according to claim 10 wherein said compound has the formula of $[Rf^1-]_2P(E)_b[—Y—Rf^2-Y—]P(E)_b[Rf^1]_2$; and $Rf^1$, E, b, Y, and $Rf^2$ are the same recited in claim 5.

15. A compound according to claim 10 wherein said compound has the formula of $[Rf^1-Y^1—]_2P(E)_b[Rf^2]P(E)_b[—Y—Rf^1]_2$; and $Rf^1$, Y, E, b, and $Rf^2$ are the same a recited in claim 5.

16. A compound according to claim 10 wherein said compound has the formula of $[(Rf^1)_2—CHO]_2P(E)_b[Rf^2]P(E)_b[—OCH(Rf^1)_2]_2$; and $Rf^1$, E, b, and $Rf^2$ are the same as recited in claim 5.

17. A compound according to claim 1 wherein said compound is a partially esterified phosphate, a partially esterified phosphonate, a salt of a partially esterified phosphate, a salt of a partially esterified phosphonate, or mixtures of two or more thereof.

18. A compound according to claim 17 comprising a mono- or poly-alkylene oxide linking groups between the phosphorus and the fluorocarbon group.

19. A compound according to claim 18 wherein said compound has the formula of $[Rf-Y—]_{(3-x-y)}—P(E)—[—Y—Rf^1]_y[OM]_x$; Rf, Y, y, E, and $Rf^1$ are the same as recited in claim 3; x is 0.05 to 1; and M is hydrogen, alkali metal, alkaline earth metal, or ammonium.

20. A compound according to claim 18 wherein said compound has the formula of $[Rf-Y—]_{(3-x-y)}—P(E)—[—OCH—(Rf^1)_2]_y[OM]_x$; and Rf, Y, x, y, E, $Rf^1$, and M are the same as recited in claim 19.

21. A compound according to claim 18 wherein said compound has the formula of $[MO]_x[Rf^1—Y—]_{(2-x)}—P(E)[—Y—Rf^2—Y—]P(E)[—Y—Rf^1]_{(2-x)}[OM^x$; M, x, $Rf^1$, E, d Y are the same as recited in claim 19; and $Rf^2$ is the same as recited in claim 5.

22. A compound according to claim 18 wherein said compound has the formula of $[MO]_x[(Rf^1)_2—CHO]_{(2-x)}—P(E)[—Y—Rf^2-Y—]P(E)[—OCH—(Rf^1)_x]_{(2-x)}[OM]_x$; and M, x, $Rf^1$, E, Y, and $R^2$ are the same as recited in claim 21.

23. A compound according to claim 17 comprising no linking group between the phosphorus and fluorocarbon group.

24. A compound according to claim 23 wherein said compound has the formula of $[Rf-]_{(3-x-y)}—P(E)[—Rf^1]_y[OM]_x$; and Rf, x, y, E, $Rf^1$, and M are the same as recited in claim 19.

25. A compound according to claim 23 wherein said compound has the formula of $[MO]_x[Rf^1-]_{(2-x)}—P(E)—Rf^2-P(E)[—Rf^1]_{(2-x)}[OM]_x$; and M, $Rf^1$, x, E, M, and $Rf^2$ are the same as recited in claim 21.

26. A compound according to claim 17 comprising only one mono-alkylene oxide or polyalkylene oxide linking group and having the proviso of (1) when said perfluoroether has a mono- or poly-alkylene oxide linking group, said fluoroalkyl has no liking group and (2) when said fluoroalkyl has a mono- or poly-alkylene oxide linking group, said perfluoroether has no linking group.

27. A compound according to claim 26 wherein said compound has the formula of $[Rf-Y—]_{(3-x-y)}P(E)[—Rf^1]_y[OM]_x$; and Rf, Y, $Rf^1$, x, y, E, and M are the same recited in claim 19.

28. A compound according to claim 26 wherein said compound has the formula of $[Rf-]_{(3-x-y)}P(E)[—Y—Rf^1]_y[OM]_x$; and Rf, x, y, E, Y, $Rf^1$, and M are the same recited in claim 19.

29. A compound according to claim 26 wherein said compound has the formula of $[Rf-]_{(3-x-y)}P(E)[—OCH—(Rf^1)_2]_y[OM]_x$; and Rf, $Rf^1$, x, y, E, and M are the same as recited in claim 19.

30. A compound according to claim 26 wherein said compound the formula of $[MO]_x[Rf^1-]_{(2-x)}P(E)[—Y—Rf^2-Y—]P(E)[—Rf^1]_{(2-x)}[OM]_x$; and M, $Rf^1$, x, E, Y, and are the same as recited in claim 21.

31. A compound according to claim 26 wherein said compound has the formula of $[MO]_x[Rf^1—Y—]^{(2-x)}P(E)[—Rf^2-]P(E)[—Y—Rf^1]_{(2-x)}[OM]_x$; and M, $Rf^1$, x, E, Y, and are the same as recited in claim 21.

32. A compound according to claim 26 wherein said compound has the formula of $[MO]_x[Rf^1—CHO—]_{(2-x)}P(E)[—Rf^2-]P(E)[—OCH—(Rf^1)_2]_{(2-x)[OM]x}$; and M, $Rf^1$, x, E, Y, and $Rf^2$ are the same as recited in claim 21.

33. A composition comprising a phosphorus-, perfluoropolyether-, and perfluoroalkyl-containing compound and optionally a thickener wherein said compound is the same as that disclosed in claim 1, 2, 3, 4, 5, 6, 7, 8, 9, 10, 11, 12, 13, 14, 15 16, 17, 18, 19, 20, 21, 22, 23, 24, 25, 26, 27, 28, 29, 30, 31, or 32.

34. A composition according to claim 33 wherein said compound is a partially esterified phosphate, a salt of a partially esterified phosphate, or mixtures thereof.

35. A composition according to claim 33 wherein said compound is a partially esterified phosphonate, a salt of a partially esterified phosphonate, or mixtures thereof.

36. A composition according to claim 33 where said thickener is polytetrafluoroethylene.

37. A composition according to claim 34 where said thickener is polytetrafluoroethylene.

38. A composition according to claim 35 where said thickener is polytetrafluoroethylene.

39. A recording medium comprising a lubricant, which comprises a phosphorus-, perfluoropolyether-, and perfluoroalkyl-containing compound as recited in claim 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31 or 32.

40. A recording medium comprising a lubricant, which comprise, a phosphorus-, perfluoropolyether-, and perfluoroalkyl-containing compound as recited in claim 33.

41. A recording medium comprising a lubricant, which comprise a phosphorus-, perfluoropolyether-, and perfluoroalkyl-containing compound as recited in claim 34.

42. A recording medium comprising a lubricant, which comprise a phosphorus-, perfluoropolyether-, and peffluoroalkyl-containing compound as recited in claim 35.

43. A recording medium comprising a lubricant, which comprise a phosphorus-, perfluoropolyether-, and perfluoroalkyl-containing compound as recited in claim 36.

44. A recording medium comprising a lubricant, which comprise a phosphorus-, perfluoropolyether-, and perfluoroalkyl-containing compound as recited in claim 37.

45. A recording medium comprising a lubricant, which comprise a phosphorus-, perfluoropolyether-, and perfluoroalkyl-containing compound as recited in claim 38.

* * * * *

UNITED STATES PATENT AND TRADEMARK OFFICE

CERTIFICATE OF CORRECTION

PATENT NO. : 6,828,284 B2 
APPLICATION NO. : 09/923838
DATED : December 7, 2004
INVENTOR(S) : John Lee Howell et al.

It is certified that error appears in the above-identified patent and that said Letters Patent is hereby corrected as shown below:

Column 13, line 22, "formula of $[Rf]_{(3-y)}$-$P(E)_b[Rf^1]_y$;" should read -- formula of $[(Rf)]_{(3-y)}$-$P(E)_b[Rf^1]_y$; --

Column 13, line 50, "formula of $[Rf^1$-$Y^1$-$]_2P(E)_b[Rf^2]P(E)_b[$-Y- $Rf^1]_2$" should read -- formula of $[Rf^1$-Y-$]_2P(E)_b[Rf^2]P(E)_b[$-Y-$Rf^1]_2$; and $Rf^1$, Y, E, b, and Rf --

Column 13, line 54, "formula of $[Rf^1)_2$-$CHO]_2P_2(E)_b[Rf^2]P(E)_b[$-$OCH(Rf^1)_2]_2$" should read -- formula of $[Rf^1)_2$-$CHO]_2P(E)_b[Rf^2]P(E)_b[$-$OCH(Rf^1)_2]_2$ --

Column 14, line 9, "formula of $[MO]_x[Rf^1$-Y-$]_{(2-x)}$-P(E)[-Y- $Rf^2$-Y-]P(E)[-Y-$Rf^1]_{(2-x)[OM]x}$; M, x, $Rf^1$, E, d Y" should read -- $[MO]_x[Rf^1$-Y-$]_{(2-x)}$-P(E)[-Y- $Rf^2$-Y-]P(E) [-Y- $Rf^1]_{(2-x)}[OM]_x$; M, x, $Rf^1$, E, and Y --

Column 14, line 25, "formula of $[MO]_x[Rf^1$-$]_{(2-x)}$-P(E)-$Rf^2$-P(E)[-$Rf^1]_{(2-x)}[OM]_x$; and M, $Rf^1$, x, E, M, and $Rf^2$" should read -- $[MO]_x[Rf^1$-$]_{(2-x)}$-P(E)-$Rf^2$-P(E)[-$Rf^1]_{(2-x)}[OM]_x$; and M, $Rf^1$, x, E, M, and $Rf^2$ --

Column 14, line 37, "are the same recited in" should read -- are the same as recited in --

Column 14, line 48, "said compound the formula" should read -- said compound has the formula --; and line 3, "and are the same as" should read -- and $Rf^2$ are the same as --

Column 14, line 52, "the formula of $[MO]_x[Rf^1$-Y-$]^{(2-x)}$P(E)[-$Rf^2$-]P(E)[-Y-$Rf^1]_{(2-x)}[OM]_x$;" should read -- $[MO]_x[Rf^1$-Y-$]_{(2-x)}$P(E)[-$Rf^2$-]P(E)[-Y-$Rf^1]_{(2-x)}[OM]_x$ --; and line 3, "and are the same" should read -- and $Rf^2$ are the same --

Column 14, line 56, "the formula of $[MO]_x[Rf^1$-CHO-$]^{(2-x)}$P(E)[-$Rf^2$-]P(E)[-OCH-$(Rf^1)_2]_{(2-x)[OM]x}$; and M, $Rf^1$, x, E, Y, and $Rf^2$" should read -- $[MO]_x[Rf^1$-CHO-$]_{(2-x)}$P(E) [-$Rf^2$-]P(E)[-OCH-$(Rf^1)_2]_{(2-x)}[OM]_x$; and M, $Rf^1$, x, E, Y, and $Rf^2$ --

Column 15, line 15, "which comprise a phosphorus-," should read -- which comprises a phosphorus- --

UNITED STATES PATENT AND TRADEMARK OFFICE

CERTIFICATE OF CORRECTION

PATENT NO. : 6,828,284 B2
APPLICATION NO. : 09/923838
DATED : December 7, 2004
INVENTOR(S) : John Lee Howell et al.

It is certified that error appears in the above-identified patent and that said Letters Patent is hereby corrected as shown below:

Column 16, line 1, "which comprise a phosphorus-," should read -- which comprises a phosphorus- --

Column 16, line 4, "which comprise a phosphorus-," should read -- which comprises a phosphorus- --

Column 16, line 7, "which comprise a phosphorus-," should read -- which comprises a phosphorus- --

Column 16, line 10, "which comprise a phosphorus-," should read -- which comprises a phosphorus- --

Column 16, line 13, "which comprise a phosphorus-," should read -- which comprises a phosphorus- --

Signed and Sealed this

Twenty-sixth Day of September, 2006

JON W. DUDAS
*Director of the United States Patent and Trademark Office*